US005533594A

United States Patent [19]

Tremblay et al.

[11] Patent Number: 5,533,594

[45] Date of Patent: Jul. 9, 1996

[54] CHAIRLIFT WITH POSITIONING CARRIAGE AND SWIVEL MECHANISM WITH SAFETY INTERLOCK

[75] Inventors: Jules M. Tremblay, Sunland, Calif.; David C. Balmer, Brampton; Helmut Ruff, Kitchener, both of Canada

[73] Assignee: Ricon Corporation, Pacoima, Calif.

[21] Appl. No.: 255,337

[22] Filed: Jun. 7, 1994

[51] Int. Cl.[6] ..... B66B 9/08

[52] U.S. Cl. ..... 187/201

[58] Field of Search ..... 187/201, 200, 187/245

[56] References Cited

U.S. PATENT DOCUMENTS

| | | | |
|---|---|---|---|
| 2,507,887 | 5/1950 | Cheney | 187/201 |
| 4,913,264 | 4/1990 | Voves et al. | 187/12 |
| 5,213,048 | 5/1993 | Kunczynski | 105/149.2 |
| 5,230,405 | 7/1993 | Bartelt | 187/201 |

FOREIGN PATENT DOCUMENTS

| | | | |
|---|---|---|---|
| 5116868 | 5/1993 | Japan | 187/201 |

*Primary Examiner*—Kenneth Noland
*Attorney, Agent, or Firm*—Darby & Darby

[57] ABSTRACT

A chairlift providing a seat for transporting a passenger along a rail inclined at a substantially uniformly angle, includes a chair assembly with a base housing a motor unit and a carriage supporting the chair assembly in a substantially upright position for movement along the rail and being positionable relative to the chair assembly to provide a spatial relationship therebetween for accommodating the angle of the inclined rail. The chairlift further includes a swivel mechanism incorporating a sliding component and a swivel component for enabling the seat to move along an arcuate path relative to the base, between a transport position and offset access positions. The chairlift also includes a safety interlock for locking the seat in the transport position and for disabling chairlift operations unless the seat is locked in the transport position.

21 Claims, 7 Drawing Sheets

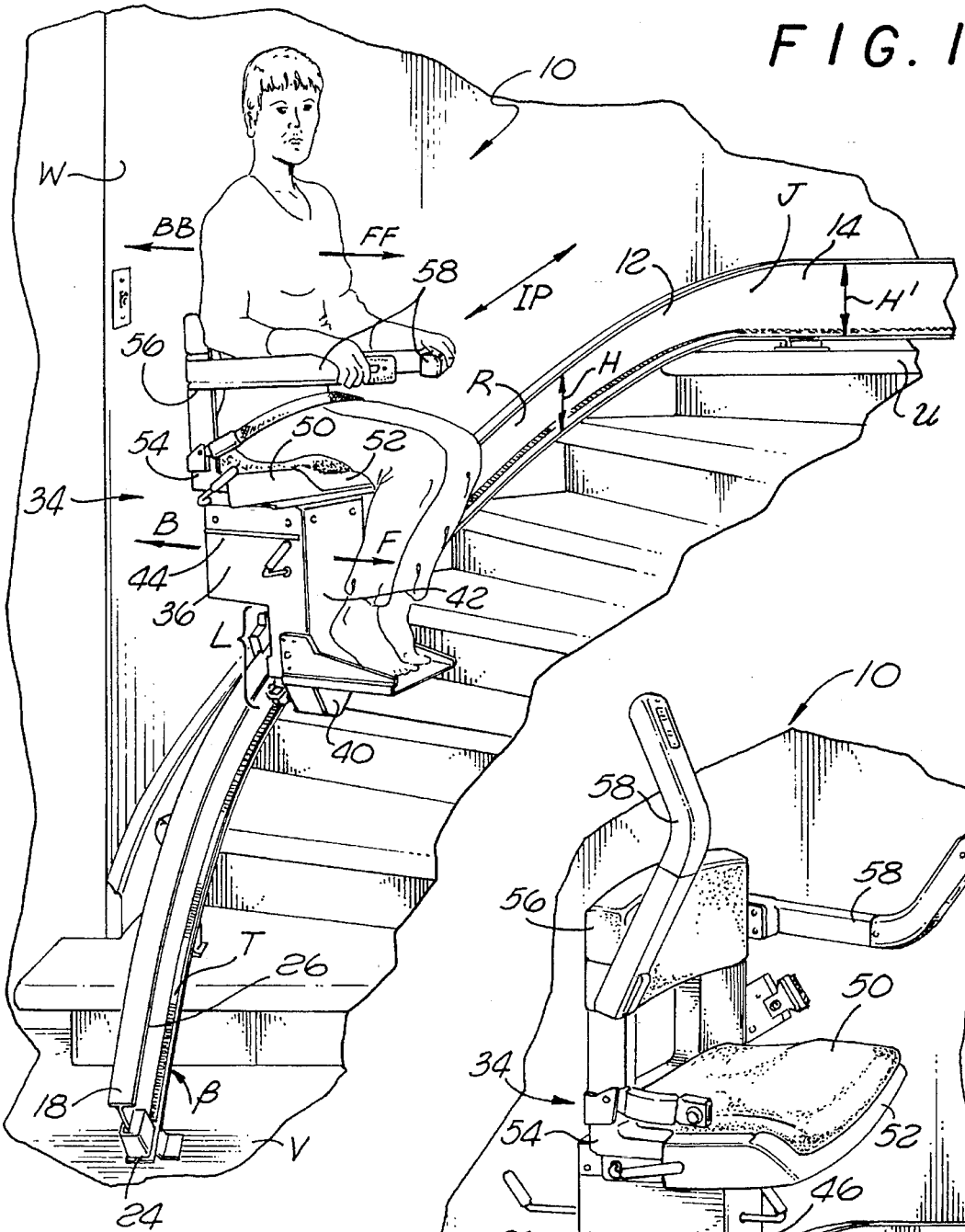
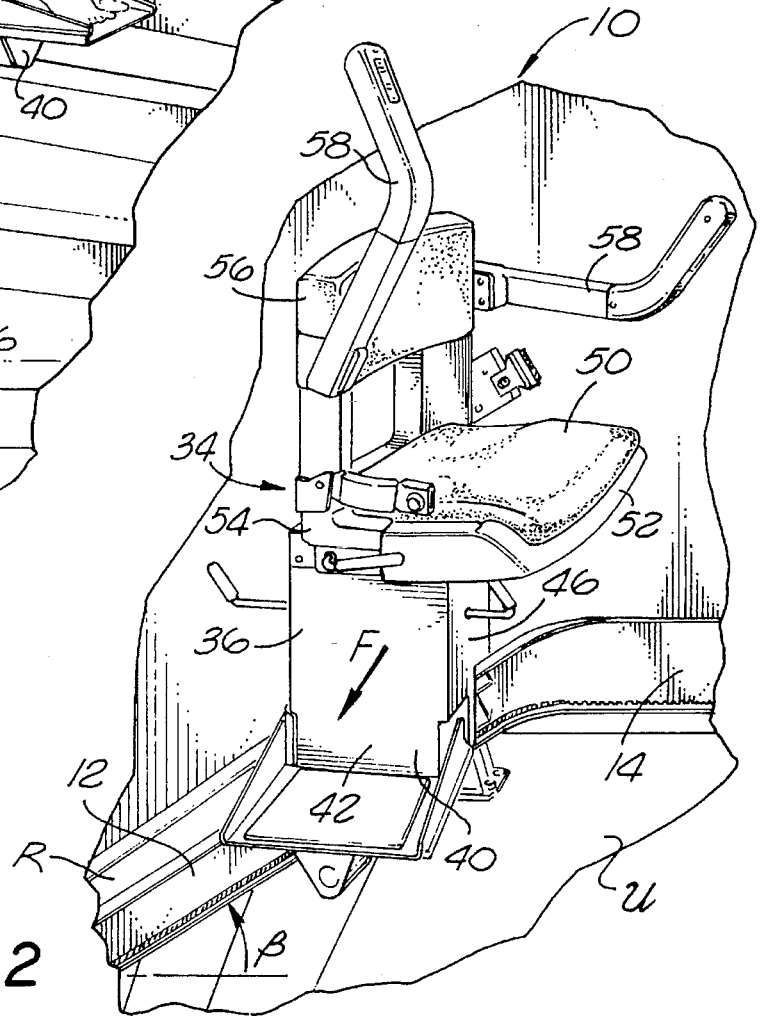
FIG. 2

FIG. 3
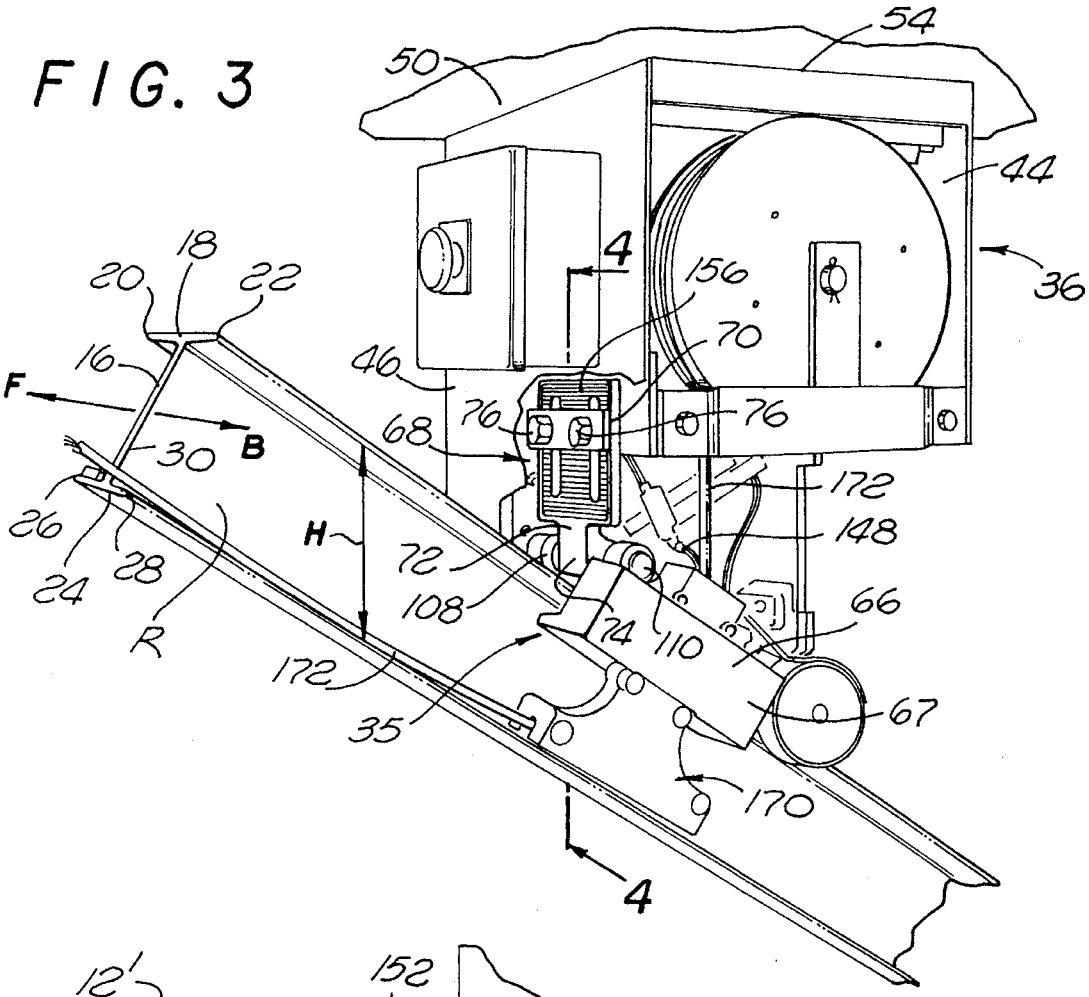
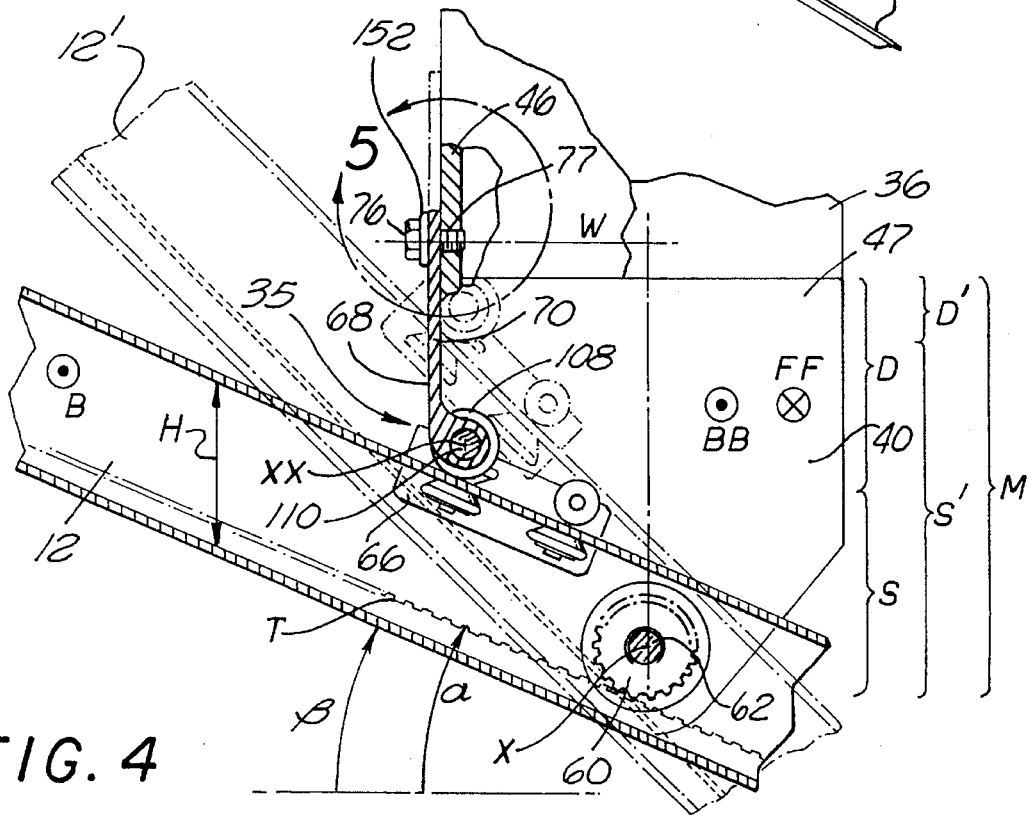
FIG. 4

CHAIRLIFT WITH POSITIONING CARRIAGE AND SWIVEL MECHANISM WITH SAFETY INTERLOCK

FIELD OF THE INVENTION

This invention relates generally to chairlifts and, in particular, to an improved chairlift adapted for transport along inclined paths, for example, over stairs.

BACKGROUND AND SUMMARY OF THE INVENTION

Considerable current concern exists for persons who are physically challenged or have limited mobility. That concern has given rise to a demand for improved structures to accommodate handicapped people, in particular, structures for transporting between different levels. Although various forms of lift apparatus exist and have helped handicapped persons considerably, their users still face many obstacles. For example, where transport is along an inclined path, the development of safe, durable and economical lifts has presented one of the more challenging problems.

Chairlifts often are driven along inclined rails. Such chairlifts typically require specially manufactured components for use with rails inclined at different angles. Without specially manufactured components, the chairlifts usually fail to operate in an upright position, often dangerously tilting passengers during transport. Moreover, chairlifts are particularly difficult for passengers in wheelchair to board and disembark and such activities on inclines may be especially dangerous. Accordingly, there exists a need for an improved chairlift facilitating boarding and disembarking and safely transporting passengers along inclined rails.

Recognizing the need for an improved chairlift, the present invention provides a chairlift accommodating most inclined rails. In particular, a carriage supporting a chair assembly for movement on an inclined rail may be selectively positioned to provide a relative spatial relationship between the carriage and the chair assembly correlating with the inclined rail. In the disclosed embodiment, a support bracket extending from the carriage may be fastened to a base of the chair assembly in different selected positions for defining different relative vertical distances between the carriage and the base. As different spatial relationships are necessary for rails of different inclination, the chairlift of the present invention may be used on most inclined rails.

Also, the chairlift incorporates a swivel mechanism for enabling a seat positioned on the base to move along an arcuate path relative to the base, between a transport position and offset access positions. The swivel mechanism includes a sliding component and a swivel component. In the disclosed embodiment, the seat is mounted on a sliding shaft extending vertically from the base and is also pivotally joined with a swivel linkage positioned horizontally between the seat and the base.

Moreover, a safety interlock is provided for use with the swivel mechanism for locking the seat in a transport position and for disabling chairlift operations unless the seat is in the transport position.

These, as well as other features of the invention, will become apparent from the detailed description which follows, considered together with the appended drawings.

DESCRIPTIONS OF THE DRAWINGS

In the drawings, which constitute a part of this specification, exemplary embodiments demonstrating various objects and features hereof are set forth as follows:

FIG. 1 is a perspective view illustrating a chairlift carrying a passenger in accordance with the present invention;

FIG. 2 is another perspective view of a chairlift in accordance with the present invention;

FIG. 3 is a further perspective view of a portion of the chairlift shown in FIG. 1;

FIG. 4 is a fragmentary vertical sectional view of the chairlift taken along a line 4—4 of FIG. 3;

DESCRIPTION OF THE ILLUSTRATIVE EMBODIMENTS

Figure 5:
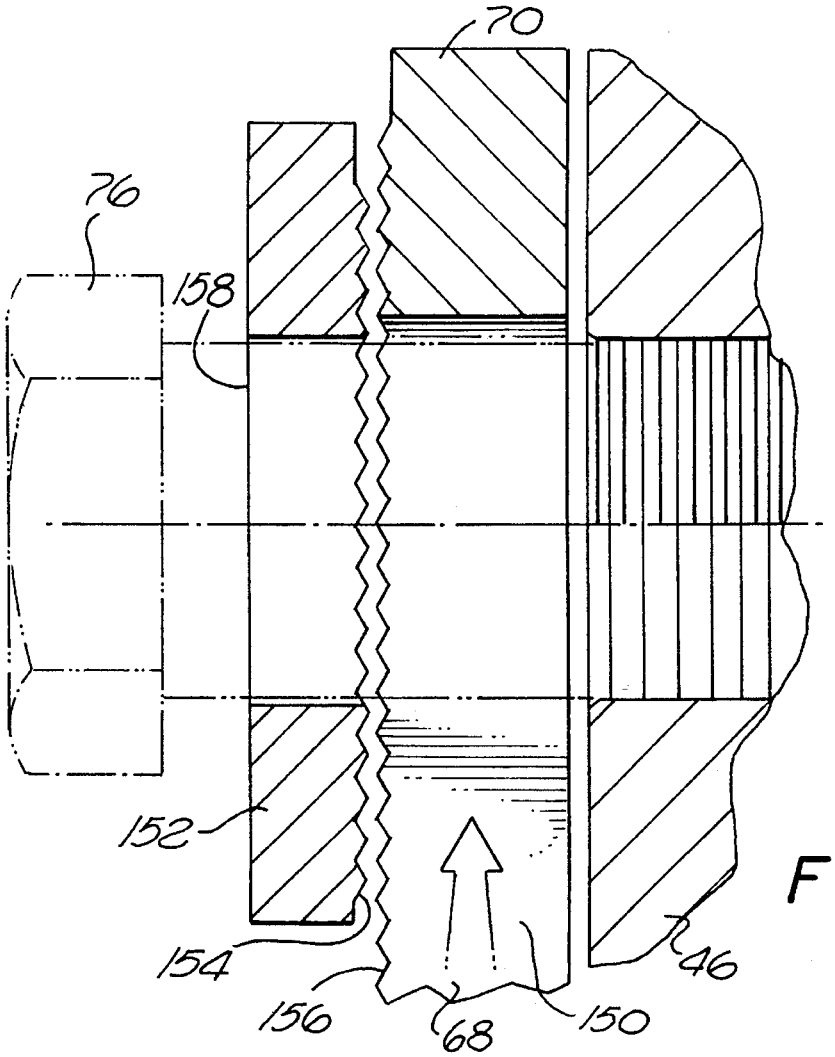
FIG. 5 is a detailed view of components in the region 5—5 of FIG. 4.

As indicated above, a detailed illustrative embodiment is disclosed herein. However, systems for accomplishing the objectives of the present invention may be detailed quite differently from the disclosed embodiment. Consequently, specific structural and functional details disclosed herein are merely representative; yet, in that regard, they are deemed to afford the best embodiment for purposes of disclosure and to provide a basis for the claims herein which define the scope of the present invention.

Referring to FIGS. 1 and 2, a chairlift 10 is provided for facilitating passenger boarding and disembarking and for transporting a passenger P safely and comfortably along an inclined path IP, between landings U and V.

An I-beam rail R, on which the chairlift 10 ascends and descends, extends substantially parallel with the inclined path IP. The rail R includes a segment 12 extending between the landings U and V. The segment 12 is substantially uniformly inclined at an angle $\beta$ and may be linear, or arcuate as shown. Where the rail R may extend along another inclined path IP' (not shown) beyond the upper landing U, the rail R may also include a horizontal segment 14 positioned on the upper landing U and joined with the segment 12 at a junction J.

Where a vertical structure, for example, a wall W, is positioned adjacent the inclined path IP, the rail R may be affixed to the lower edge of the wall W. To facilitate the description of the chairlift 10, reference is made to a relative backward direction BB substantially toward the wall W and a relative forward direction FF substantially away from the wall W. Moreover, reference is made to a relative backside B as a surface substantially toward the wall W and a relative frontside F as a surface substantially away from the wall W.

Referring also to FIG. 3, an I-section 16 of the rail R defines an upper track 18 with flanges 20 and 22, a lower track 24 with flanges 26 and 28, and a panel 30 separating the upper track 18 from the lower track 24 by a vertical distance H. The panel 30 substantially delineates the frontside F and the backside B of the rail R. The significance of which is explained further below, the separation between the tracks 18 and 24 increase from a vertical distance H in the segment 12 to a greater vertical distance H' in the segment 14.

Referring also to FIG. 4, on the frontside F of the rail R, the flange 26 of the lower track 24 carries a plurality of teeth T (shown in broken lines) forming a rack 32 extending along the length of the lower track 24. Note that in FIG. 4, the frontside F of the rail R faces into the page and the backside B of the rail R faces out of the page.

More clearly shown in FIGS. 1 and 2, the chairlift 10 includes a chair assembly 34 carried on the rail R by a carriage 35. The chair assembly 34 includes a base 36 housing a motor unit 38 (not shown) for driving the chairlift 10 along the rail R, and a leg 40 extending a length L from the base 36. The base 36 and the leg 40 are substantially enclosed by a front panel 42, a left panel 44, a right panel 46, and a top panel 48. The left and right panels 44 and 46 are recessed at their lower portions to form the leg 40. To further enclose the leg 40, a back panel 47 (FIG. 4) is provided between the left and right panels 44 and 46, below the base 36.

The chair assembly 34 also includes a seat 50 positioned above the base 36, having a front edge 52 and a rear edge 54. A back rest 56 extends vertically from the rear edge 54 of the seat 50 and a pair of safety arms 58 extends horizontally from the back rest 56, turning inward to secure the passenger P on the seat 50 during operation of the chairlift 10. The safety arms 58 may be lifted from their lowered position for passenger boarding or disembarking.

Illustrated in FIGS. 3 and 4, the leg 40 at the backside B of its lower end carries a pinion 60 (FIG. 4) rotatably mounted on a shaft 62 extending horizontally from the back panel 47. So mounted, the pinion 60 engages the rack 32 on the frontside F of the rail R. Coupled to the pinion 60, the motor unit 38 drives the pinion 60 to move the chair assembly 34 along the rail R.

As shown in FIG. 4, the pinion 60 substantially provides a first point (or location) X where the chair assembly 34 relates to the rail R. The point X is positioned substantially a vertical distance M below the base 36.

Figure 9:
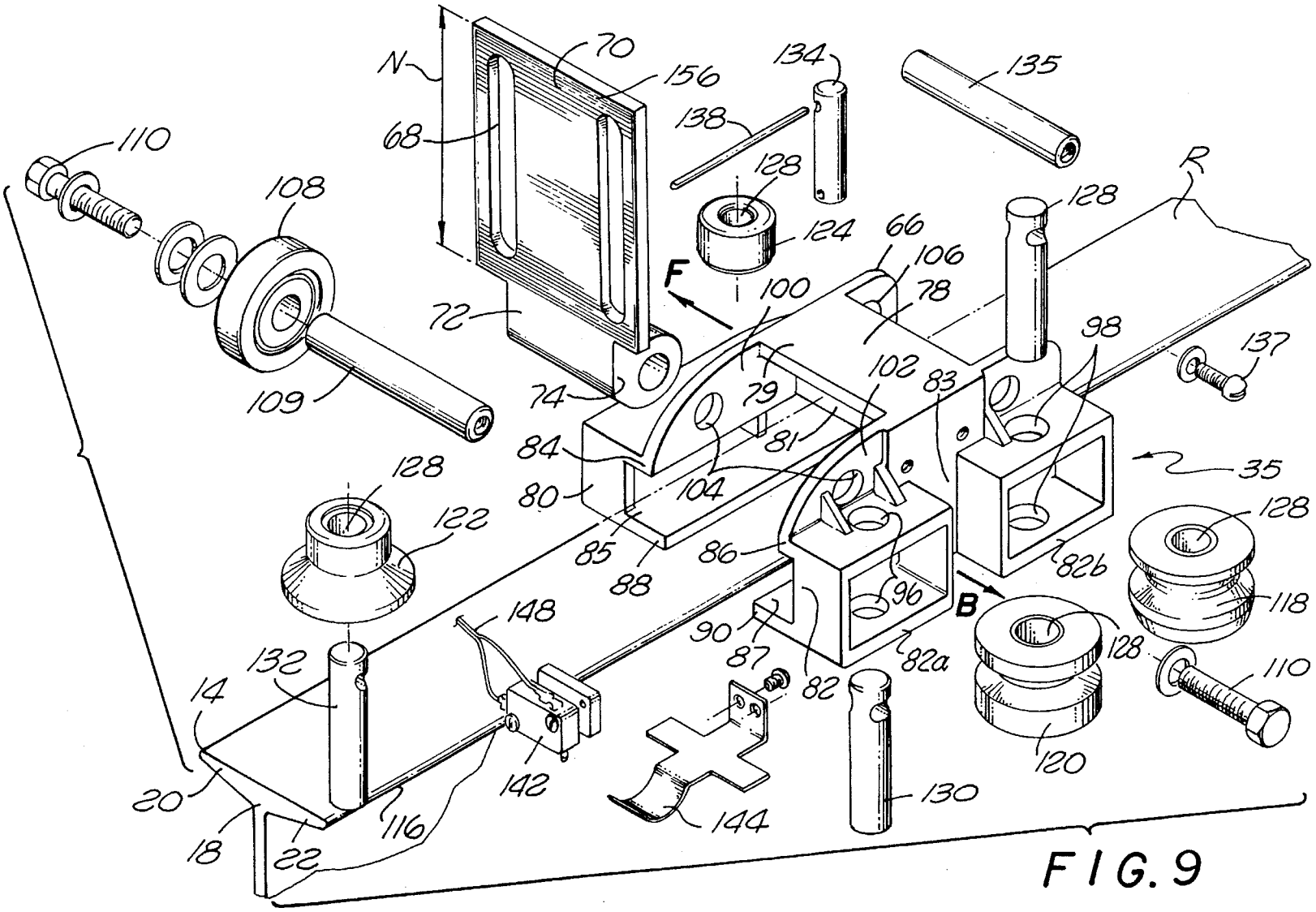
FIG. 9 is an exploded perspective view of a component embodied in the chairlift shown in FIG. 1.

Referring to FIGS. 3, 4 and 9, the carriage 35 substantially stabilizes and carries the chair assembly 34 on the rail R. The carriage 35 includes a tracking body 66 encased in a cover 67, and a support bracket 68 extending substantially vertically from the tracking body 66 to the chair assembly 34. The support bracket 68 is constructed of steel or the like and has a substantially planar upper portion 70 and a lower portion 72 configured to provide a horizontal sleeve 74. The planar upper portion 70 has a length N, and is fastened to the right panel 46 of the base 36 by fasteners, for example, bolts 76, inserted through two bores 77 (FIG. 4) in the right panel 46 of the base 36. As such, the sleeve 74 is positioned substantially a vertical distance D (FIG. 4) below the base 36.

Referring specifically to FIG. 9, beneath the cover 67, the tracking body 66 includes a center portion 78 positioned between depending side brackets 80 and 82. The center portion 78 is somewhat T-shaped, having a horizontal planar portion 79 and a vertical planar portion 81, and is positioned centrally above the upper track 18. The brackets 80 and 82 are somewhat U-shaped with channels 85 and 87 facing each other from opposite sides of the upper track 18. The side bracket 80 is substantially wrapped about the flange 20 extending into the channel 85, the side bracket 80 forming the frontside F of the tracking body 66. The side bracket 82 is substantially wrapped about the flange 22 extending into to the channel 87, the side bracket 82 forming the backside B of the tracking body 66.

The side bracket 80 has an upper leg 84 and a lower leg 88; likewise, the side bracket 82 has an upper leg 86 and a lower leg 90. Although the side bracket 80 is substantially continuous, the side portion 82 is configured into two portions **82*a* and 82*b*, defining a gap 83 therebetween. Extending between the upper legs 84 and 86 of the side brackets 80 and 82 and the center portion 78 are vertical flanges 100 and 102**.

A pair of bores 92 and a pair of slots 94 (FIG. 9) are provided in the upper and lower legs 84 and 88 of the side bracket 80, and two additional pairs of bores 96 and 98 are provided in the upper and lower legs 86 and 90 of the side bracket portions **82*a* and 82*b*. Bores 104 and 106 are also provided in the flanges 100 and 102**.

In order to support the carriage 35 for movement along the rail R, the carriage 35 includes a vertical wheel 108 positioned substantially between the side brackets 80 and 82 to engage the flange 20 of the upper track 18. The vertical wheel 108 is rotatably mounted to the tracking body 66 by a journal 109 fastened to the tracking body 66 through the bores 104, between the side bracket 80 and the side bracket portion **82*a*, by cap screws 110 extending through the bores 104. Accordingly, the vertical wheel 108 rolls freely on the flange 20 of the upper track 18 as the carriage 35 travels with the chair assembly 34** along the rail R.

Engaging the upper track 18, the tracking body 66 includes, for example, various horizontal wheels housed in the side brackets 80 and 82. Providing substantial lateral thrust capacity, flanged wheels may be provided to engage the flanges 20 and 22 of the upper track 18. The flanged wheels are positioned such that they substantially contact outer edges 114 and 116 of the flanges 20 and 22, respectively. As shown in FIG. 9, the side bracket portion **82*b* houses a double-flanged, single-bearing wheel 118 and the side bracket portion 82*a* houses a double-flanged, double-bearing wheel 120. The side bracket 80 houses a single-flanged, single-bearing wheel 122, as well as a flat pressure wheel 124. The wheels 118 and 124, and 120 and 122 are symmetrically positioned about the upper track 18 such that they define substantially rectangular vertices of the tracking body 66**.

Each of the wheels 118, 120, 122, and 124 has a vertical bore 128 for receiving pins 128, 130, 132 and 134, respectively. These pins are inserted through the bores 98, 96, and 92 and the slots 94 of the side brackets 80 and 82, to rotatably mount the wheels in the tracking body 66. The pins 130 and 132 are fastened to the tracking body 66 by bolts 110. The pin 128 is fastened to the tracking body 66 at the upper end by a cap screw 137 and the pin 134 is fastened to the tracking body 66 by spring pins 138 and 139 (latter not shown). Rotatably mounted to the tracking body 66, the wheels 118, 120, and 122 secure the carriage 35 to the upper track 18 to substantially counter act lateral thrusts exerted by the chair assembly 34 and/or the passenger P.

Opposing the journal 109 and the cap screws 110, a journal 135 is fastened to the tracking body 66 through the bores 106. The journal 135 is positioned between the side bracket 80 and the side bracket portion 82*b* by the cap screw 137 inserted through the bores 106.

Figure 9A:
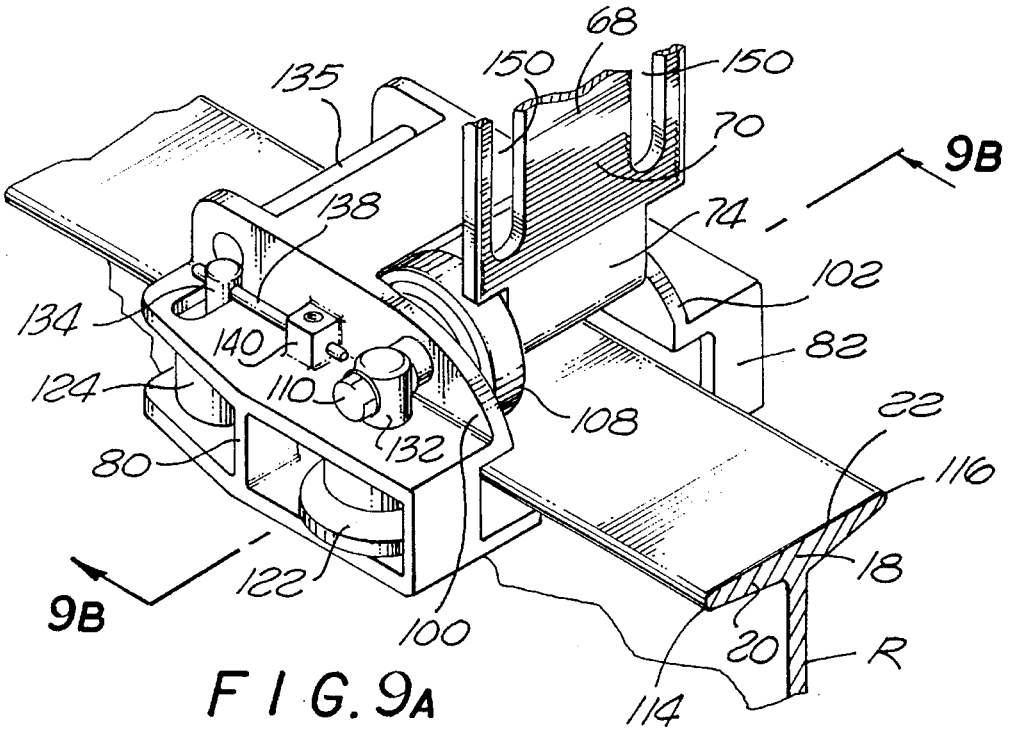
FIG. 9A is a fragmentary perspective view of the components shown in FIG. 9.

Referring also to FIG. 9A, the pin 134 for the flat pressure wheel 124 is inserted through the slots 94 in the side bracket 80, as described above. Although the pin 134, and thus, the flat pressure wheel 124, may be laterally displaced from the edge 114 of the flange 20 (as permitted by the slots 94), the pin 134 and the flat pressure wheel 124 are biased toward the edge 114 by spring pins 138 and 139 (latter not shown) mounted horizontally to the upper and lower leg 84 and 88 of the side bracket 80. As concerning the spring pin 138, one end thereof is rigidly affixed to the upper leg 84 at a point 140 and the other end is inserted through the top end of the pin 134. The spring pin 139 is similarly arranged on the underside of the lower leg 88 of the side bracket 80. Consequently, the flat pressure wheel 124 is enabled to damp vibrations, as perhaps resulting from misalignment of the various mechanical components in the carriage 35.

Figure 9B:
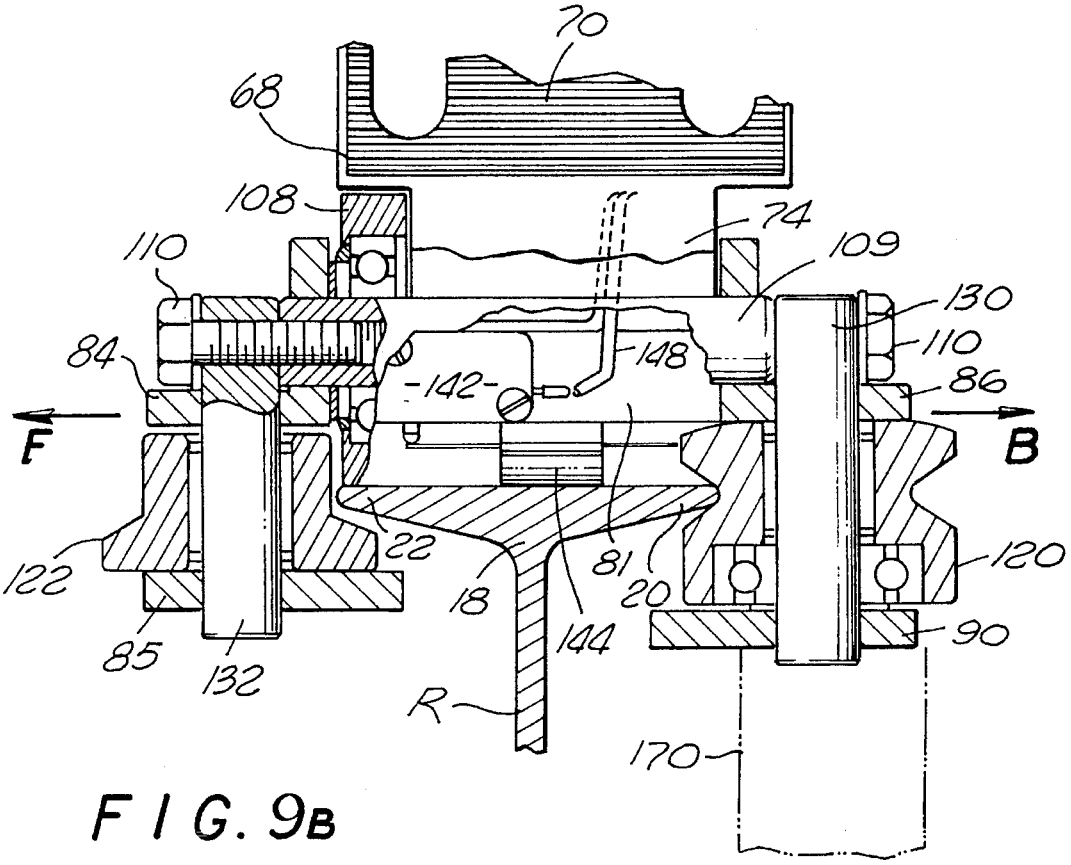
FIG. 9B is fragmentary sectional view of the components taken along a line 9B—9B shown in FIG. 9A.

Referring also to FIG. 9B, a spring actuated switch 142 is included in the carriage 35 as a safety precaution to disable the motor 38 (not shown) if the carriage 35 disengages from the upper track 18. Specifically, the spring actuated switch 142 is positioned on a spring actuator 144 affixed to the vertical portion 81 of the center portion 78. The spring actuator 144 is biased by, for example, the upper track 18, to close the normally-open switch 142 for enabling the motor 38 through a wire harness 148. If the carriage 35 disengages from the upper track 18 such that the spring actuator 144 is no longer biased by the upper track 18 to close the switch 142, the switch 142 disables the motor unit 38.

Supporting the chair assembly 34 in a substantially upright position, the support bracket 68 is pivotally joined with the tracking body 66 at the sleeve 74 by the journal 109. The sleeve 74 of the support bracket 68 is positioned between the vertical wheel 108 and the flange 100 of the side bracket 80 substantially between the side brackets 80 and 82. Accordingly, the tracking body 66 pivots relative to the support bracket 68 about the journal 109 while the support bracket 68 remains substantially vertical beneath the base 36.

As also shown in FIG. 4, the vertical wheel 108 substantially provides a second point (or location) XX at which the chair assembly 34 relates to the rail R. Since the vertical wheel 108 and the sleeve 74 are both rotatably mounted to the tracking body 66 by the journal 109, the second point XX is positioned substantially the vertical distance D beneath the base 36, as previously defined. Jointly, the points X and XX define a spatial relationship between the carriage 35 and the chair assembly 34 necessary for the chair assembly 34 to be laterally stable and positioned substantially upright on the inclined segment 12.

In the disclosed embodiment, the spatial relationship may include a lateral distance W and a vertical distance S between the two points X and XX. To that end, it is observed that the sum of the vertical distances D and S must substantially equate with the vertical distance M for the chair assembly 34 to be level. However, it is also observed that the vertical distance M may not be randomly apportioned between the vertical distances D and S without consideration of the angle β.

To demonstrate a correlation between the spatial relationship and the angle β, assume that the chair assembly 34 is positioned on a segment 12' inclined at a greater angle α (shown in broken lines). For the chair assembly 34 to be positioned substantially even or upright on the segment 12', again, the sum of the vertical distances D and S must substantially equate with the vertical distance M; however, the vertical distance D must be decreased while the vertical distance S increased to accommodate the angle α. Otherwise, the chair assembly 34 will cant to the right on the segment 12'.

Although the angle α may be accommodated by decreasing the lateral distance W, the chair assembly 34 will lose lateral stability. By maintaining the lateral distance W, and shortening the vertical distance from D to D' (and lengthening the vertical distance S to S'), the chair assembly 34 is positioned substantially upright on the segment 12' without compromising lateral stability.

Recognizing the correlation between the spatial relationship and the angle β, the present invention enables the carriage 35 to vary the spatial relationship between the carriage 35 and the chair assembly 34 for accommodating most inclined rails. In the disclosed embodiment, the support bracket 68 is provided with two vertical slots 150 (FIG. 3) for enabling the carriage 35 to be fastened in a selected position for providing the spatial relationship correlating with the inclined segment 12. Because the vertical slot 150 receives the bolts 76 fastening the support bracket 68 to the base 36, the support bracket 68 may be raised or lowered to vary the vertical distance D between the carriage 35 and the base 36. Although bores may be provided, the slots 150 enable finer selection of the vertical distance D.

Without the carriage 35, the chair assembly 34 would require different carriages for proper operation on rails of different inclination. It is thus appreciated that the present invention substantially obviates the need for different carriages because the carriage 35 may be used to support the chair assembly 34 substantially upright on rails inclined at angles between approximately 22 degrees to 44 degrees.

Furthermore, referring to FIG. 5, the support bracket 68 is locked in the selected position by a locking plate 152. The locking plate 152 has a serrated surface 154 mating with another serrated surface 156 on the planar portion 70 of the support bracket 68. The locking plate 152 defines two bores 158 substantially matching the two bores 77 (FIG. 4) of the right panel 46 of the base 36 for receiving the bolts 76 fastening the support bracket 68 to the base 36. Accordingly, the support bracket 68 is securely fastened to the base 36 in the selected position.

It is noted that as the chairlift 10 travels from the inclined segment 12 to the horizontal segment 14, the support bracket 68 need not be repositioned for accommodating the decrease from the angle β to substantially zero. As indicated earlier, the panel 30 of the rail R increases in separation from H to H' in the area of the junction J (FIG. 1). With the increase in separation from H to H', the spatial relationship between the carriage 35 and the chair assembly 34 is maintained.

As shown in FIG. 3, a cable guide assembly 170 is mounted to the side bracket 82 of the carriage 35 to extend adjacent the backside B of the rail R. The cable guide assembly 170 houses various rollers (not shown) to guide a cable 172 supplying electrical power to the chair assembly 34. The cable 172 is fed through the cable guide assembly 170, up through the gap 83 between the side bracket portions 82*a* and 82*b*, and up toward the base 36, through an opening (not shown) in the cover 67. Excess length of the cable 172 is coiled about a drum 176 housed in the base 36 of the chair assembly 34.

Figure 6:
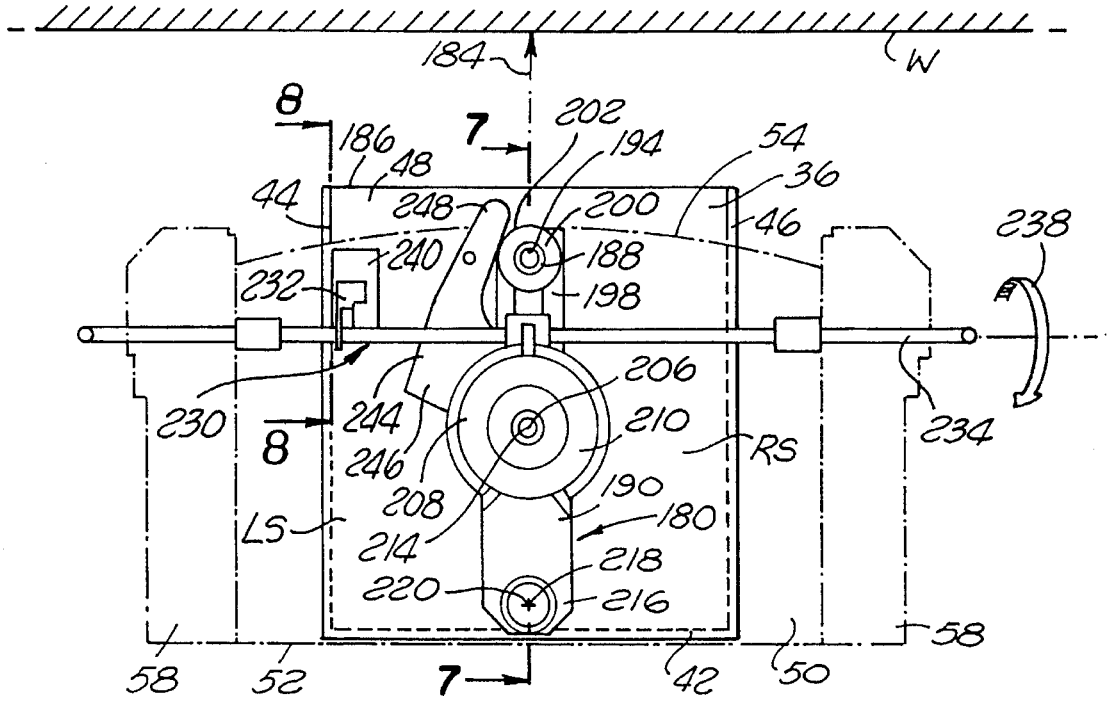
FIG. 6 is a top plan view of a chairlift in accordance with the present invention wherein a seat in a transport position is shown in broken lines to reveal supporting components underneath.
Figure 6A:
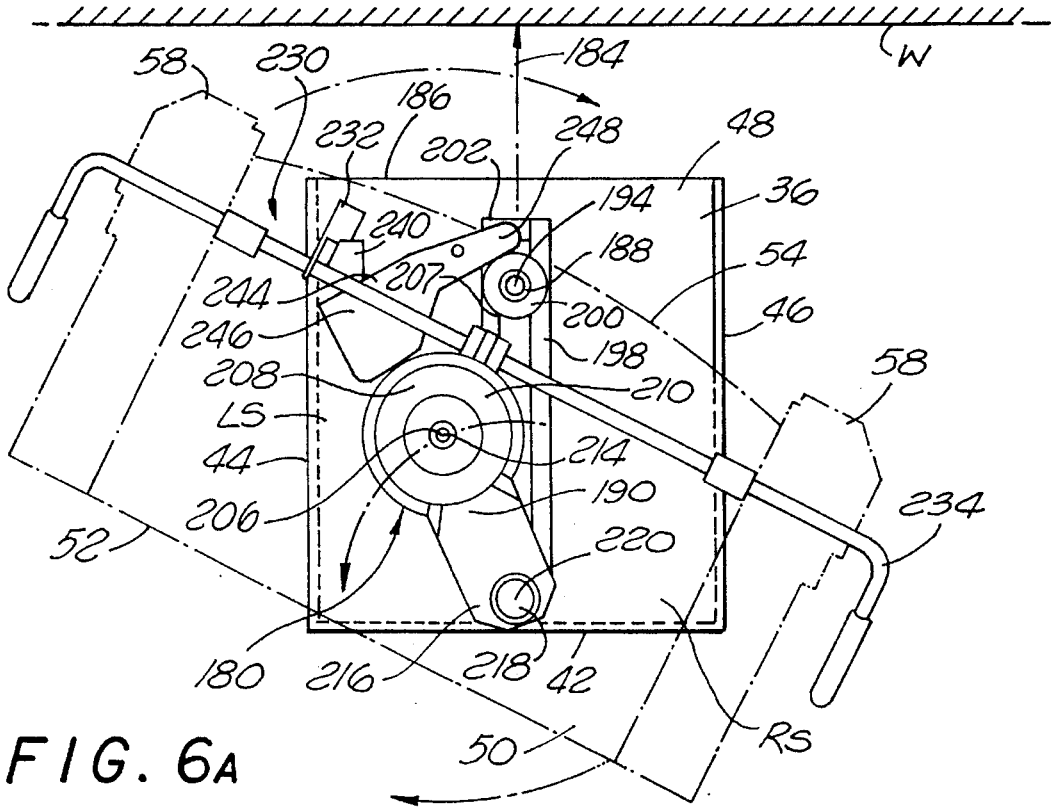
FIGS. 6A and 6B are top plan views of the components of FIG. 6, showing the seat in an arcuate movement between the transport position of FIG. 6 and an offset access position.
Figure 6B:
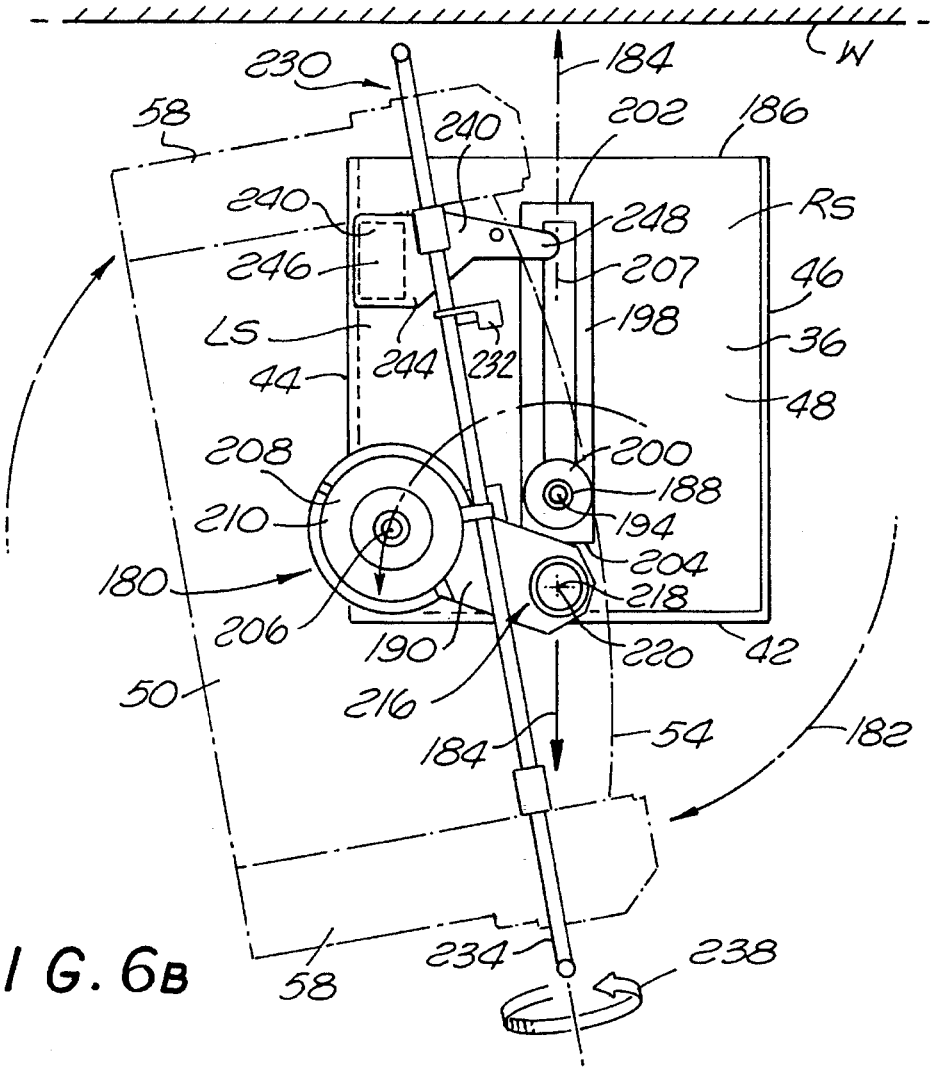

Referring to FIGS. 6, 6A and 6B, the present invention includes a swivel mechanism 180 enabling an arcuate motion in the seat 50 relative to the base 36. As such, the seat 50 moves along an arcuate path 182 (FIG. 6B), between a transport position (FIG. 6) and offset access positions (FIGS. 2 AND 6B). The arcuate motion results from various motions in the seat 50, including linear as well as pivotal motions, being combined by the swivel mechanism 180.

For simplifying the description of the arcuate motion, a central axis 184 is defined as being transverse relative to the wall W and extending across the base 36 from a back edge 186 to the front panel 42. The axis 184 partitions an area 185 above the base 36 into a left section LS and a right section RS, coinciding with the left panel 44 and the right panel 46, respectively.

In the transport position (FIG. 6), the seat 50 is substantially centered relative to the base 36. In particular, the seat 50 is centered relative to the axis 184, with the rear edge 54 substantially parallel to and adjacent the wall W. In the transport position, the seat 50 extends minimally, if at all, beyond the base 36 where the front edge 52 of the seat 50 is substantially coplanar with the front panel 42 of the base 36. As the passenger P is transported on the chairlift 10, she is substantially centered on the chair assembly 34, facing in the forward direction FF.

In the offset access positions (e.g., FIG. 6B), the seat 50 extends beyond the base 36. Because the seat 50 is displaced both from the wall W and the axis 184, the front edge 52 of the seat 50 in, for example, the left offset access position extends beyond the front panel 42, as well as left panel 44, of the base 36. Where the chair assembly 34 is at the landing V, the front edge 52 of the seat 50 in the left offset access position extends onto the landing V for facilitating access to the seat 50 from the landing V when the passenger P boards, and for facilitating access to the landing V from the seat 50 when the passenger P disembarks. Accordingly, the passenger P need not be on the inclined path IP when boarding or disembarking and substantially avoids injury from falling. Where the passenger P is in a wheelchair, the seat 50 extending onto the landing V especially facilitates the passenger P moving between the wheelchair and the seat 50.

The arcuate motion enables the seat 50 to extend beyond the base 36 when needed. In that respect, the arcuate motion also allows the seat 50 to move relative to the base 36 in a manner for avoiding collision with the wall W. Without the arcuate motion substantially translating the seat 50 transversely from the wall W, the seat 50 may be obstructed by the wall W as it moves between the transport and the offset access positions. Enabled by the swivel mechanism 180, the seat 50 moves along the arcuate path 182 without displacement of the base 36 relative to the rail R.

The swivel mechanism 180 includes a sliding component and a swivel component. In the disclosed embodiment, the swivel mechanism 180 includes a sliding shaft 188 and a swivel linkage 190. Whereas the sliding shaft 188 is positioned vertically between the seat 50 and the base 36, the swivel linkage 190 is positioned horizontally between the seat 50 and the base 36.

Figure 7:
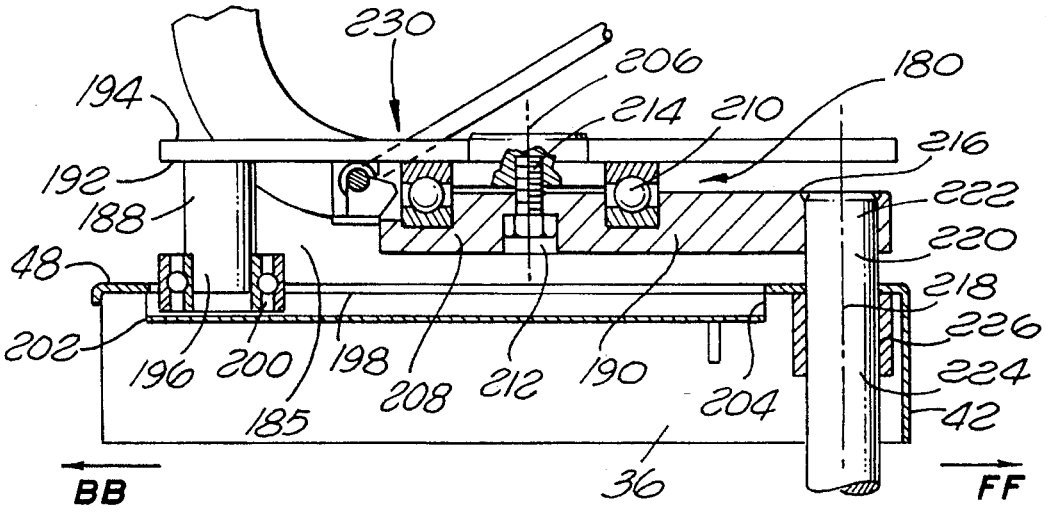
FIG. 7 is a vertical sectional view taken along a line 7—7 of FIG. 6.

Referring also to FIG. 7, the seat 50 is mounted on an upper end 192 of the sliding shaft 188, at a midpoint 194 (FIG. 6) adjacent the rear edge 54 of the seat 50. A lower end 196 of the sliding shaft 188 is positioned in an elongate guide channel 198 formed in the top panel 48 of the base 36. A bearing member, for example, a guide bearing 200, is provided at the lower end 196 of the sliding shaft 188 to facilitate linear motion of the sliding shaft 188 in the guide channel 198, as well as rotation of the seat 50 about the midpoint 194.

Extending along the axis 184, between a back stop 202 and a front stop 204, the guide channel 198 limits the linear motion of the sliding shaft 188 accordingly. Since the sliding shaft 188 is mounted to the seat 50 at the midpoint 194, the midpoint 194 substantially translates between the front panel 42 and the back edge 186, as the sliding shaft 188 substantially translates between the front stop 204 and the back stop 202.

To enable the passage of electrical power between the base 36 and the seat 50, the sliding shaft 188 may be equipped with electrical circuitry extending along its length, where the circuitry at the lower end 196 may conduct with an electrically-conducting strip 207 lining the guide channel 198. Thus, a control switch located on the safety arms 58 may be enabled for controlling chairlift operations.

As the sliding shaft 188 moves the midpoint 194 of the seat 50 along the axis 184, the swivel linkage 190 complements the sliding shaft 188 in accomplishing the arcuate motion by moving a central point 206 of the seat 50 into one of the sections LS and RS above the base 36.

As shown in FIGS. 6, 6A, 6B and 7, the swivel linkage 190 has one end 208 pivotally affixed to the seat 50 at the central point 206. Integrally provided in the end 208 of the swivel linkage 190 is a bearing member, for example, a ball bearing 210, having a bore 212 (FIG. 7) for receiving a bolt 214 extending vertically into the seat 50 at the central point 206. Thus, the seat 50 is pivotable relative to the swivel linkage 190 about the central point 206 to provide the arcuate motion.

Moving the central point 206 of the seat 50, another end 216 of the swivel linkage 190 is pivotally affixed to the base 36 at a point 218 substantially on the axis 184, adjacent the front panel 42 of the base 36. A vertical shaft 220 is provided, with an upper end 222 mounted into the end 216 of the swivel linkage 190 and a lower portion 224 pivotally mounted in the base 36 with a bushing member 226 (FIG. 7). Accordingly, the swivel linkage 190 is pivotable relative to the base 36 about the point 218.

To simplify the description provided hereinbelow, pivotal positions of the linkage 190 relative to the base 36 about the point 218 range between substantially zero degree and 180 degrees, with zero degrees being substantially as shown in FIG. 6B, 45 degrees being substantially as shown in FIG. 6A and 90 degrees being substantially as shown in FIG. 6. Pivotal positions beyond 90 degrees are substantially as illustrated in the FIGS. 6, 6A and 6B, but mirror images thereof. For example, 135 degrees is substantially a mirror image of FIG. 6A and 180 degrees is substantially a mirror image of FIG. 6B.

FIGS. 6, 6A, and 6B illustrates movement of the swivel mechanism 180 as the seat 50 (broken lines) moves from the transport position to the access positions. While the seat 50 is in the transport position (FIG. 6), the sliding shaft 188 is positioned at the back stop 202 of the guide channel 198 and the swivel linkage 190 is positioned substantially at 90 degrees.

As the seat 50 is moved from the transport position to, for example, the left offset access position (FIGS. 6A and 6B), the sliding shaft 188 slides toward the front stop 204 as guided by the guide channel 184, and the central point 206 of the seat 50 is pushed into the left section LS. This occurs because the sliding shaft 188 forces the swivel linkage 190 to pivot counterclockwise about the point 218 from substantially 90 degrees to substantially zero degree. Since the midpoint 194 of the seat 50 is confined to the axis 184, the seat 50 must pivot about both the midpoint 194, as well as the central point 206, and consequently be displaced offset from both the wall W and the axis 184. So displaced, the front edge 52 of the seat 50 is substantially parallel with the axis 184 and extending beyond the base 36 onto the landing V to facilitate passenger boarding and disembarking.

As the seat 50 is returned to the transport position from the left offset access position, the sliding shaft 188 slides toward the back stop 202 and the central point 206 of the seat 50 is pulled back to the axis 184. This occurs because the swivel linkage 190 is forced to pivot clockwise from substantially zero degree, back to 90 degrees as the sliding shaft 188 approaches the back stop 202. Again, the seat 50 must pivot about both the midpoint 194 and the central point 206 to return to the transport position.

As the seat 50 is moved from the transport position to the right offset access position (FIG. 2), the central point 206 is pushed into the right section RS as the sliding shaft 188 forces the swivel linkage 190 to pivot clockwise about the point 218, from substantially 90 degrees to substantially 180 degrees. As the seat 50 is returned to the transport position, the central point 206 is again pulled back to the axis 184 with the swivel linkage 190 pivoting counterclockwise about the point 218, from substantially 180 degrees back to substantially 90 degrees. Similarly, the seat 50 must pivot about both the midpoint 194 and the central point 206 as it moves between the transport position and the right offset access position.

Throughout the arcuate motion, the sliding shaft 188 remains on the axis 184, whereas the swivel linkage 190 pivots about the point 218, ranging substantially between zero and 90 degrees for the left access position and between 90 and 180 degrees for the right access position. Additionally, whereas relative distances between the sliding shaft 188 and the central point 206, and between the central point 206 and the vertical shaft 220, are maintained, a relative distance between the sliding shaft 188 and the vertical shaft 220 varies as the seat 50 moves along the arcuate path 182.

Distinctly, the swivel mechanism 180 of the present invention enables the seat 50 to move along the arcuate path 182 for avoiding contact with the wall W, between the transport position where the seat 50 extends minimally, if at all, beyond the base 36, and offset access positions where the seat 50 extends onto the landings U and V for facilitating boarding and disembarking.

Figure 8:
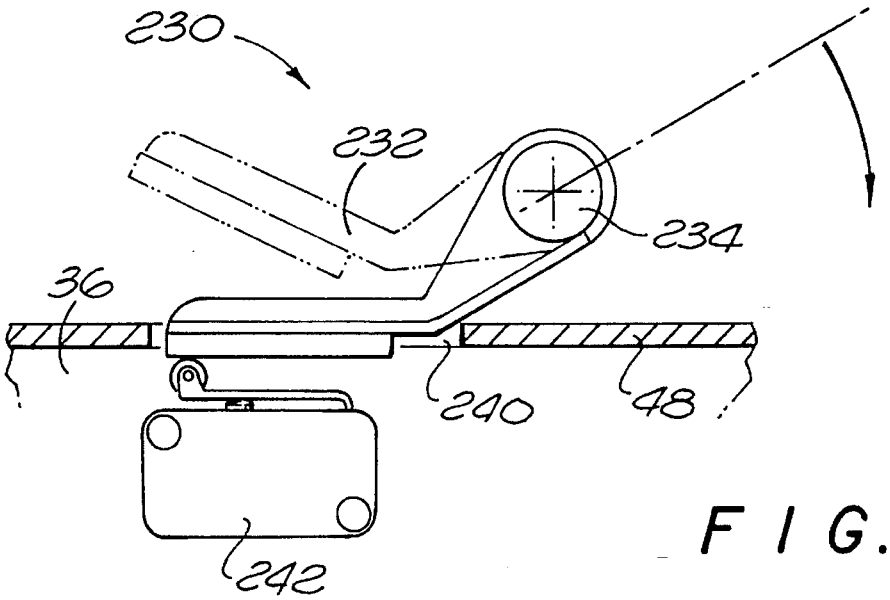
FIG. 8 is essentially a side elevation view of components embodied in the chairlift taken along a vertical line 8—8 in FIG. 6.

Referring also to FIG. 8, the swivel mechanism 180 includes a safety interlock 230 for locking the seat 50 in the transport position during chairlift operations. The safety interlock 230 includes an arm or dog 232 depending from a rotatable shaft or turnbar 234 extending laterally under the seat 50. The turnbar 234 is bent at its ends, toward the frontside direction FF, to form handles 236. The turnbar 234 is rotatably mounted under the seat 50 such that it may be rotated about its length, as indicated by an arrow 238, by the handles 236, between a locked position where the handles 236 extend horizontally (FIG. 6A), and an unlocked position where the handles 236 extend vertically (FIGS. 6 and 6B).

Referring also to FIG. 8, the dog 232 in the locked position as shown in solid lines, extends downwardly to engage an opening 240 provided in the top panel 48 of the base 36. As such, the safety interlock 230 immobilizes the seat 50 with respect to the base 36, preventing the seat 50 from moving out of the transport position. To release the safety interlock 230, the handles 236 are lifted from the horizontal position to the vertical position, thereby rotating the turnbar 234 about its length and disengaging the dog 232 from the opening 240, as shown in FIG. 8 in broken lines. Thereafter, the seat 50 may be moved from the transport position to the left or right offset access positions.

As a further safety consideration, the safety interlock 230 disables all chairlift functions unless the seat 50 is in the transport position. The dog 232 may be adapted to close a normally open contact switch 242 provided in the base 36 and accessible through the opening 24. When the seat 50 is locked in the transport position by safety interlock 230, the dog 232 (shown in solid lines) closes the switch 242, completing an electrical circuit through the switch 242. The circuit is designed so that the main control power of the motor unit 38 passes through the switch 242.

When the seat 50 is out of the transport position, the dog 232 (shown in broken lines) is out of contact with the switch 242, leaving the switch 242 open for disabling the motor unit 38.

Moreover, to prevent debris collecting in the opening 240, and/or the passenger P circumventing the safety interlock 230, a protective plate 244 is provided. The protective plate 244 has a wide portion 246 configured in dimension comparable to the opening 240, and a leg 248. The protective plate 244 is pivotally mounted between the wide portion 246 and the leg 248, to the top panel 48 of the base 36, adjacent the opening 240. The protective plate 244 is biased, for example, by springs 250 (not shown) such that the wide portion 246 is positioned substantially above and covering the opening 240 and the leg 248 extends into the guide channel 198, adjacent the backstop 202. So biased, the wide portion 246 obstructs access to the opening 240, as well as the switch 242.

When the seat 50 is in the transport position (FIG. 6), the sliding shaft 188 is at the back stop 202 of the guide channel 198, thereby displacing the leg 248 from the guide channel 198 against the bias of the springs 250. Consequently, the wide portion 246 is displaced from above the opening 240, enabling the dog 232 to engage the switch 242.

As the seat 50 moves out of the transport position, the sliding shaft 188 moves from the back stop 202 of the guide channel 198, allowing the protective plate 244 to resume its biased position to cover the opening 240. Consequently, unless the seat 50 is in the transport position, the opening 240 is substantially inaccessible from above the base 36.

Prior to operation of the chairlift 10, it is necessary to position the carriage 35 to provide the necessary spatial relationship between the carriage 35 and the chair assembly 34. In particular, the support bracket 68 is raised or lowered with respect to the base 36 to provide the vertical distance D as correlating with the angle $\beta$ of the segment 12. So positioned, the carriage 35 supports the chair assembly 34 substantially upright on the segment 12.

In operation, the passenger P first boards the chairlift 10, for example, from the upper landing U (FIG. 2). Positioned on the upper landing U, the passenger P lifts the handles 236 of the turnbar 234, unlocking the seat 50 from the transport position, and moves the seat 50 in the arcuate path 182 to the right offset access position. The seat 50 avoids contact with the wall W and extends onto the landing U to facilitate boarding therefrom. The passenger P may then board the chairlift 10 and be seated on the seat 50, facing in the forward direction FF.

Once on the seat 50, the passenger P swivels the seat 50 back to the transport position and lowers the handles 236, locking the seat 50 in the transport position. With the seat 50 locked in the transport position, the safety interlock 230 enables the motor unit 38 for chairlift operations. The passenger P may lower the safety arms 58 to secure herself on the chairlift 10 and she is ready for transport.

To descend from the upper landing U, the passenger P depresses the control switch on the safety arms 58 for controlling the motor unit 38 to drive the pinion 60 along the rack 32 provided on the lower track 24. While the pinion 60 moves the chair assembly 34 along the segment 12, the carriage 35 travels with the chair assembly 34, supporting the chair assembly 34 substantially at level.

When the chairlift 10 arrives at the lower landing V, the passenger P releases the control switch on the safety arms 58 to stop the chairlift 10. She may then raise the safety arms 58 and proceed to lift the handles 236, unlocking the seat 50 from the transport position. As the handles 236 are lifted, the safety interlock 230 disenables the motor unit 38 and the passenger P moves the seat 50 from the transport position to the right access position. The seat 50 moves along the arcuate path 182, avoiding contact with the wall W, and extends onto the landing V to facilitate disembarking.

It may be seen that the system of the present invention may be readily incorporated in various embodiments to provide a chairlift enabling safe access and transport. The various components and dimensions disclosed herein, including distances and separations therebetween, are merely exemplary, and of course, various alternative techniques may be employed departing from those disclosed and suggested herein.

Consequently, it is to be understood that the scope hereof should be determined in accordance with the claims as set forth below.

What is claimed is:

1. A chairlift providing a seat for transporting a passenger along a rail inclined at a substantially uniformly angle, the chairlift comprising:

a chair assembly including a base housing a motor unit;

a carriage substantially supporting said chair assembly in a substantially upright position for movement along said rail, said carriage including a positioning structure for positioning said carriage and said chair assembly in a spatial relationship for accommodating said angle; and a locking plate locking said support bracket to said base in said selected position, said support bracket providing a first serrated surface engageable with a second serrated surface provided on said locking plate.

2. A chairlift in accordance with claim 1, wherein said support bracket includes a slotted attachment structure permitting finer selection of said selected position.

3. A chairlift in accordance with claim 2, further comprising:

a swivel mechanism positioned between said seat and said base for moving said seat in an arcuate path relative to said base between a transport position and offset access positions, said swivel mechanism including a sliding component and a swivel component.

4. A chairlift providing a seat for transporting a passenger along a rail substantially uniformly inclined at an angle, the chairlift comprising:

a chair assembly having a base and positioned on said inclined rail; and a swivel mechanism positioned substantially between said seat and said base for enabling said seat to move along an arcuate path relative to said base between a transport position and an offset access position, said swivel mechanism including a sliding component and a swivel component.

5. A chairlift in accordance with claim 4, wherein said swivel component has one end pivotally mounted to said seat and another end pivotally mounted to said base.

6. A chairlift in accordance with claim 5, wherein said sliding component has one end mounted to said seat and another end positioned within an elongate guide channel provided on said base.

7. A chairlift in accordance with claim 6, wherein said one end of said swivel component is pivotally mounted to a central point of said seat and said other end of said swivel component is pivotally mounted to a midpoint adjacent a front edge of said base.

8. A chairlift in .accordance with claim 7, wherein said guide channel extends along a central axis of said base extending from a back edge to said front edge.

9. A chairlift in accordance with claim 4, further comprising a safety interlock for locking said seat in said transport position.

10. A chairlift in accordance with claim 9, wherein said safety interlock includes a normally-open switch for disabling chairlift functions unless said seat is in said transport position.

11. A chairlift in accordance with claim 9, wherein said safety interlock includes a rotatable shaft and an arm depending therefrom for closing said switch.

12. A carriage for use with a chair assembly transporting a passenger along a rail substantially uniformly inclined at an angle, said inclined rail providing a substantially flat track having flanges extending the length of said rail, said carriage comprising:

a tracking body positioned on said flat track for substantially supporting said chair assembly for movement along said rail, said tracking body including rollers to engage said flanges of said track;

a support bracket extending from said tracking body to said chair assembly, said support bracket having one end pivotally joined with said tracking body, and another end fastened to said chair assembly in a selected position to provide a relative distance between said tracking body and said chair assembly; and a locking plate for locking said support bracket to said chair assembly in said selected position, wherein said support bracket provides a first serrated surface engageable with a second serrated surface provided on said locking plate.

13. A carriage in accordance with claim 12 wherein said support bracket includes a slotted fastening structure receiving fasteners for enabling finer selection of said selected position.

14. A swivel mechanism for use with a chair lift having a seat positioned on a base and moving along an inclined rail positioned adjacent a vertical structure, said swivel mechanism enabling said seat to move in an arcuate path relative to said base between a transport position and an access position, said seat in said transport position being substantially centered relative to said base and said seat in said access position being substantially offset relative to said base and extending beyond said base, said arcuate path being a combination of a pivotal motion and a linear motion, said swivel mechanism comprising:

a swivel linkage positioned between said seat and said base, said linkage having an end pivotally affixed to said seat and another end pivotally affixed to said base; and a sliding shaft extending vertically from said base to said seat, having one end fixedly mounted to said seat, and another end positioned in a guide channel provided on the base and slidable therein.

15. A chairlift for transporting a passenger along an inclined rail, comprising:

a chair portion providing a seat for said passenger;

a base portion positioned beneath said chair portion and remaining in substantially vertical alignment therewith, said base portion engaging said rail for moving said chair portion along said rail; and a carriage travelling on said rail with said chair portion and positioned a relative distance below said chair portion, said carriage having a positioning structure for adjusting said relative distance for supporting said chair portion in a substantially upright position.

16. A chairlift in accordance with claim 15 wherein said positioning structure comprises a support bracket extending between said carriage and said chair portion, said support bracket being releasably fastened to said chair portion.

17. A chairlift in accordance with claim 16, wherein said support bracket is fastened to said chair portion by a locking plate.

18. A chairlift for transporting a passenger along on an inclined rail, the chairlift comprising:

a chair assembly having a base portion configured to define a first engagement location at which said chair assembly engages said rail; and a carriage travelling on said rail with said chair assembly, said carriage engaging said rail at a second engagement location, said carriage being configured to allow adjustment of a relative distance between said first and second engagement locations.

19. A chairlift in accordance with claim 18, wherein said carriage comprises a locking structure for releasably locking said carriage with said chair assembly for maintaining said relative distance between said locations.

20. A carriage for use with a chair assembly transporting a passenger along a rail, said carriage providing support to said chair assembly from below, said carriage comprising:

a tracking body engaging said rail and travelling with said chair assembly;

a support structure extending vertically from the tracking body at one location to another location at said chair assembly, said support structure being configured to enable adjustment of a relative distance between said locations for supporting said chair assembly in a substantially upright position.

21. A chairlift in accordance with claim 20, further comprising a releasable fastener for fastening said support structure to said chair assembly at said distance.

* * * * *

UNITED STATES PATENT AND TRADEMARK OFFICE

CERTIFICATE OF CORRECTION

PATENT NO. : 5,533,594
DATED : July 9, 1996
INVENTOR(S) : Jules M. Tremblay et al.

It is certified that error appears in the above-identified patent and that said Letters Patent is hereby corrected as shown below:

Title page,
Item [73], Assignee, replace "Ricon Corporation, Pacoima, Calif." with
-- Concord Elevator, Inc., Ontario, Canada --.

Signed and Sealed this

Ninth Day of March, 2004

JON W. DUDAS
*Acting Director of the United States Patent and Trademark Office*